United States Patent [19]

Beckwith

[11] 4,034,866

[45] July 12, 1977

[54] HANGER SUPPORT STRUCTURE FOR SHIPPING CONTAINER

[76] Inventor: Leonard J. Beckwith, 16 Buttonwood Lane, Weston, Mass. 02193

[21] Appl. No.: 628,604

[22] Filed: Nov. 4, 1975

[51] Int. Cl.[2] ..... A47F 7/19

[52] U.S. Cl. ..... 211/124; 206/279; 206/291; 403/231

[58] Field of Search ..... 211/105.1, 123, 124; 248/221, 226 E, 316 D, 226 B, 226 R, 316 A, 316 R, 264, 119; 206/279, 280, 288–298; 312/259, 108; 403/192, 193, 231, 233

[56] References Cited

U.S. PATENT DOCUMENTS

| | | | |
|---|---|---|---|
| 1,394,287 | 10/1921 | Denning | 211/123 |
| 1,408,553 | 3/1922 | Wedemann | 403/231 |
| 2,633,979 | 4/1953 | Warnick | 211/123 X |
| 2,822,093 | 2/1958 | Graci | 206/279 X |
| 2,838,356 | 6/1958 | Lane | 312/259 |
| 3,298,503 | 1/1967 | Field et al. | 206/279 |
| 3,394,518 | 7/1968 | Worrell, Jr. | 403/231 X |
| 3,519,139 | 7/1970 | Brennan | 211/124 |
| 3,633,760 | 1/1972 | Vosbikian | 211/124 |
| 3,743,106 | 7/1973 | Maziarka et al. | 206/290 X |
| 3,800,960 | 4/1974 | Collin | 206/289 X |

*Primary Examiner*—Roy D. Frazier
*Assistant Examiner*—Terrell P. Lewis
*Attorney, Agent, or Firm*—Joseph S. Iandiorio

[57] ABSTRACT

A hanger support structure for a shipping container including a pair of struts; a pair of clips for receiving and extending above the top end of each of the struts, respectively; the part of each of the clips extending above the struts forming an engaging portion; each of the clips having a back wall, two side walls adjoining the back wall and two keying segments joined to the side walls and forming a part of the front wall; a cross-bar having a locking portion at each end including a pair of mortices on opposite sides of the cross-bar for engaging the keying segments with the locking portion which is received in the engaging portion of the clip; and adhesive means on the back of each of the struts for fastening each of the struts to a portion of a shipping container.

3 Claims, 14 Drawing Figures

HANGER SUPPORT STRUCTURE FOR SHIPPING CONTAINER

FIELD OF INVENTION

This invention relates to a hanger support structure for a shipping container, and to a clip used in that structure, and more particularly to such a structure which may be universally applied to containers without special adaptation of the containers.

BACKGROUND OF INVENTION

Quality garments are usually shipped on hangers in corrugated fibreboard (sometimes referred to as cardboard) containers in order to ensure that the garments reach their destination with a minimum of soiling and rumpling. The containers use a hanger or cross-bar, typically mounted on the sides of the box, for supporting the hangers. In transit the containers are often dropped from as high as tailgate height, or are knocked over causing forces of from 20 to 150 pounds to be applied to the hangers and cross-bar. This force of 20 to 150 pounds is far in excess of the 80 or 90 pound static load of the garments. The force from such a shock can cause the hangers to come off the cross-bar, collapse the cross-bar, collapse the container, or tear the area of the container supporting the cross-bar. To enable the containers to withstand such shocks the containers are usually specially designed and fabricated with extra heavy weights and thickness of corrugated fibreboard throughout all surfaces or over the complete container in order to withstand those shock forces which are generated in the cross-bar supporting areas. Occasionally wooden upright pieces are used in this area. But they are much larger and more expensive than required to withstand the shock, for they must be made large enough to receive staples, nails and the like without splitting and with enough thickness to prevent nails and staples from protruding from the other side. Plastic and metal struts are typically more expensive than wood for equivalent loading capabilities. Cross-bars of metal are expensive and when metal cross-bars for a whole range of lenghts and loading are to be available, a number of different sizes of metal shock and tools must be available to facilitate production of the different sizes needed.

SUMMARY OF INVENTION

It is therefore an object of this invention to provide an improved, universal, simple, inexpensive and lightweight hanger support structure and clip used therein.

It is a further object of this invention to provide such a structure which may be and typically is used with very lightweight, containers to support hangered garments without special adaptation, heavier container construction, or specific reinforcement of the container.

It is a further object of this invention to provide such a structure which may be used with lower tare (net) weight containers to reduce commodity rate shipping costs of loaded containers.

It is a further object of this invention to provide such a structure and clip which uses struts, cross-bars, and clips of optimum size dependent of the desired loading capacity and not on the necessity to accommodate nails or staples without splitting.

It is a further object of this invention to provide such a structure in which the struts and cross-bars may be independently enlarged or diminished in cross-section to accommodate greater or lesser loading and in which a standardized clip (or one whose dimensions are concomittantly increased or decreased) may be used without requiring any changes in the container.

It is a further object of this invention to provide such a structure in which the struts, cross-bars and hold-down bar have the same width and the clips have virtually the same width for ease in packing and shipping to points of assembly of container.

It is a further object of this invention to provide such a structure in which the struts and hold-down bar are of the same cross-section and formed from the same stock for economy of materials.

It is a further object of this invention to provide such a structure in which the strength of the hold-down bar may be added to that of the cross-bar to withstand the load as a combined web.

It is a further object of this invention to provide such a sturcture in which the clip as well as the strut is fastened to the container to provide greater security at the top of the strut at the cross-bar where the destructive forces are greatest.

The invention results from the realization that a universal hanger support structure for a shipping container could be made independent of the shipping container itself using a pair of struts and a cross-bar of the minimum necessary cross-section and a pair of clips joining each of the struts with the end of a cross-bar and securing each of the strut and clip combinations to the inside of the container using an adhesive material.

The invention features a hanger support structure for a shipping container which includes a pair of wooden struts and a pair of clips for receiving and extending above the top end of each of the struts. The part of each of the clips that extends above the struts forms an engaging portion. Each of the clips has a back wall, two side walls joining the back wall and two keying segments joined to the side walls and forming a part of a front wall. A cross-bar has a locking portion at each end including a pair of mortices on opposite sides of the cross-bar for engaging the keying segments with the locking portion which is received in the engaging portion of the clip. Adhesive means on the back of each of the struts is used to fasten each of the struts to the shipping container.

In preferred embodiments the hanger support structure also includes a hold-down bar having a locking portion at each end including a pair of mortices on opposite sides of the hold-down bar for engaging the keying segment with the locking portion of the hold-down bar which is received in the engaging portion of the clip above the cross-bar. One or more ties may be used to fasten together the cross-bar and the hold-down bar to enable their combined widths to oppose bending forces imposed on them by the static and shock loading from the weight of the clothing.

Each clip may include a locking tab extending upwards from the back wall at the engaging portion; the locking tab is bent over against the top of the hold-down bar to keep it in position during shipping. The locking tab may be notched at its lower end proximate its connection with the back wall in order to make it easier to bend. Each clip also includes at least one inwardly dimpled area along its lower edge for limiting downward motion of the clip on the strut. Typically, the clip includes a recess in the lower portion of its back wall having the same shape and size as the locking tab and the dimpled area along the lower edge of the clip is actually located on the upper border of the recess. The recess results from the economical manufacturing process which enables each locking tab to be made from the blank removed from the recess in the adjacent clip. The clip contains at least one inwardly lanced area to secure the clip to the strut.

The strut includes a flat back surface joined with each of two side surfaces and a front surface with rounded corners joining the side surfaces. The rounded front surfaces prevent sharp edges from catching on the clothing and the flat back surface provides a maximum area for adhesive material which fastens the strut to the container. The top of the strut received in the clip is flat for receiving the bottom of the cross-bar.

The cross-bar includes a top and a bottom surface joined by two side surfaces; the junction of one of the side surfaces and the bottom surface is chamfered to accommodate hooks of hangers. The junctions of the side surfaces with the top surface are rounded to accommodate hooks of hangers.

The adhesive material may be doublesided tape or an adhesive coating applied to the back of the strut and the back of the clip. The cross-bar, struts and the hold-down bar may have the same width for ease of shipping and packaging. The hold-down bar may have the same cross-section as the strut so that the hold-down bars may be made of the scrap material left over from the making of the struts. Typically, the struts, hold-down bar and cross-bar are wood and the clip is metal. For increased capacity the hold-down bar, cross-bar and struts may be increased in width or thickness or both dimensions without necessarily requiring a change in the size of the clip.

DISCLOSURE OF PREFERRED EMBODIMENT

Other objects, features and advantages will occur from the following description of a preferred embodiment and the accompanying drawings, in which.

Figure 1:
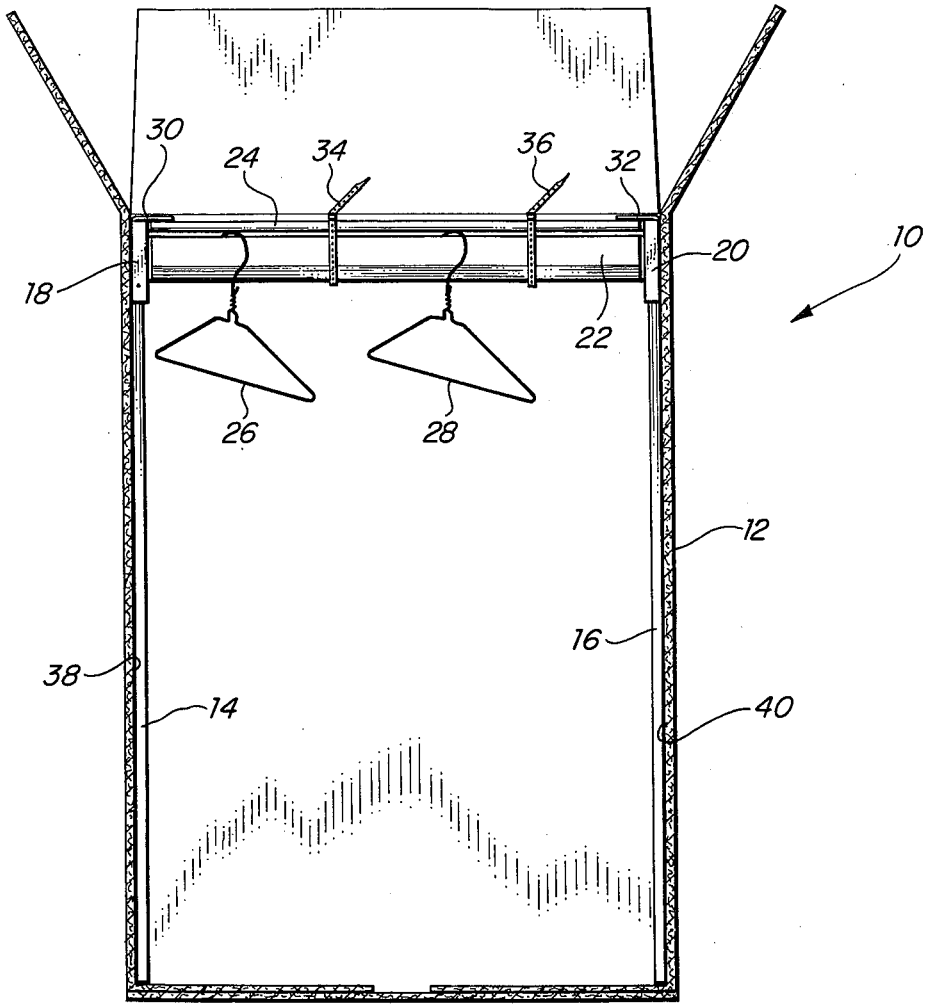
FIG. 1 is a front, sectional view of a shipping container showing the position of the hanger support structure of this invention installed in a container.

There is shown in FIG. 1 a hanger support structure 10 mounted in a corrugated fibreboard or cardboard container 12. Hanger support structure 10 includes wooden struts 14 and 16 mounted on which are metal clips 18 and 20 which support wood hanger support bar or cross-bar 22 and hanger lock bar or hold-down bar 24. The wood grain extends generally longitudinally in struts, 14, 16 and bars 22 and 24. A plurality of hangers bearing garments, illustrated by hangers 26 and 28, are hung over cross-bar 22 and held in place by hold-down bar 24 which is locked in position by locking tabs 30, 32 of clips 18 and 20, respectively. One or more ties 34, 36 made of wire, metal, plastic or the like may be used to tightly bind the hold-down bar 24 to cross-bar 22 so that the thickness of hold-down bar 24 is added to that of cross-bar 22 in opposing bending forces caused by the weight of the load on the cross-bar. Ties 34, 36 may be commercially available ties, such as No. 08471 Bar-Lok (plastic) Cable Ties by Dennison Mfg. Co., Framingham, Mass. 01701. Struts 14 and 16 are secured to container 12 by means of an adhesive medium 38, 40, respectively, which may be a hot melt type of adhesive coating such as Thermogrip Adhesive No. 1315, Bostik Division, USM Corp. or a double-sided adhesive tape such a Scotch Brand Double Coated Tape No. Y 444, 3M Co., St. Paul, Minn. The tape or the hot melt adhesive may be applied continuously from top to bottom over the back of the clip and the strut or in a succession of spaced areas. Struts 14 and 16 extend to and may rest on the bottom of container 12. Typically, struts 14 and 16 are mounted vertically at the center of each of the end panels **12*a*, 12*b* of container 12**.

Figure 2:
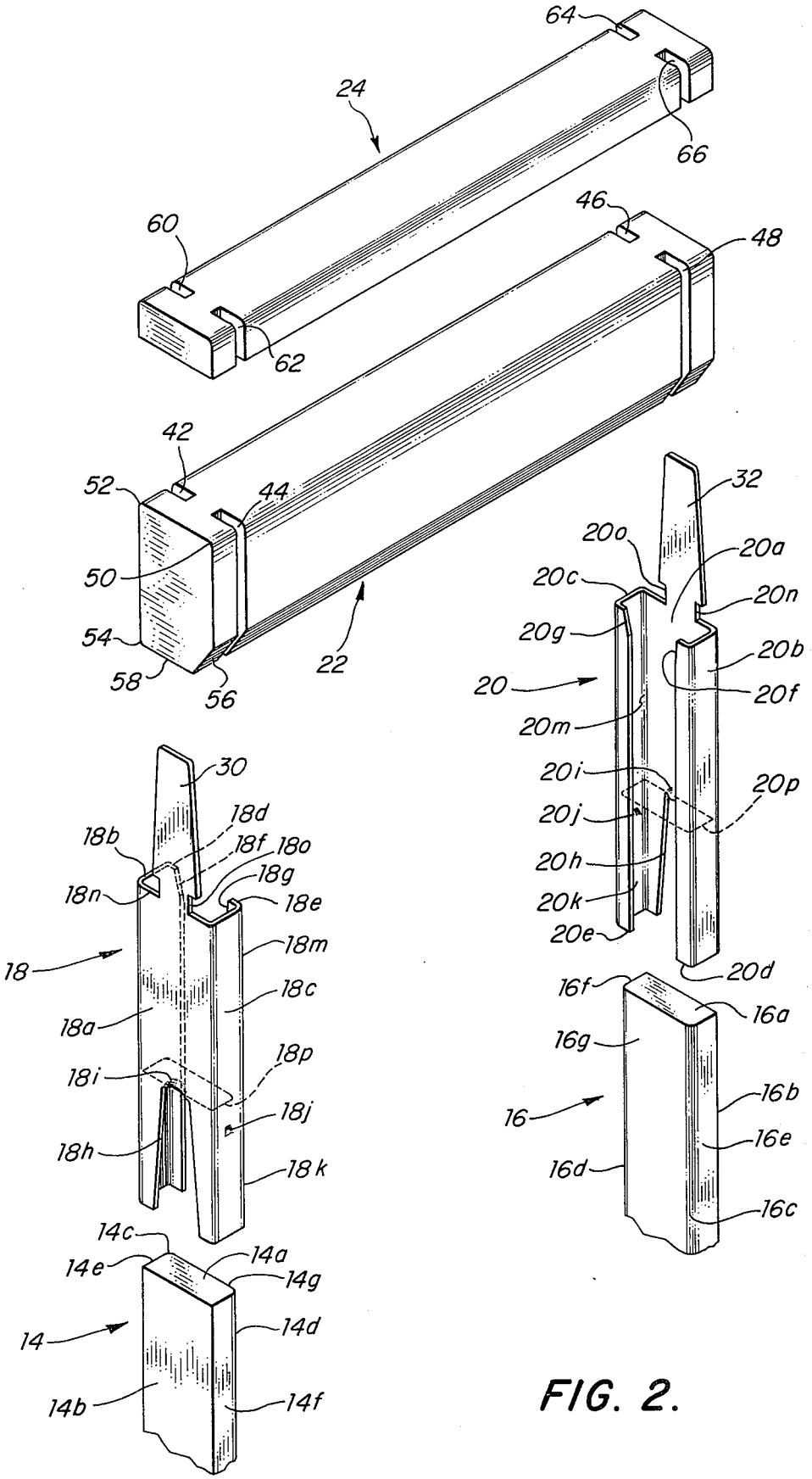
FIG. 2 is an exploded, axonometric view showing the hanger support structure of FIG. 1, including a hold-down bar, a cross-bar, a pair of clips and portions of a pair of struts.
Figure 8:
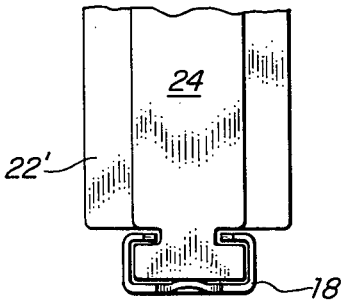
FIG. 8 is a top view of a portion of the hold-down bar and a cross-bar of increased width mounted in a clip.

Locking tab 30 of clip 18 extends from a body portion which is formed essentially of a C-shaped channel having a back wall **18*a*, FIG. 2, joining two side walls 18*b* and 18*c*. Also joining side walls 18*b* and 18*c* are keying segments 18*d* and 18*e* which form a part of a front wall. The upper corners of keying segments 18*d* and 18*e* are angled as at 18*f* and 18*g* to facilitate insertion of cross-bar 22 and hold-down bar 24. There is a recess 18*h* in a lower portion of back wall 18*a* where metal was removed during the manufacturing process to form the locking tab of a neighboring clip. Inwardly dimpled area 18*i* is located at the upper border of recess 18*h*. Inwardly dimpled area 18*i* engages the upper surface 14*a* of strut 14 to provide a downward limit for the mounting clip 18 on strut 14. The top 14*a* of strut 14 is flat to provide a support for the bottom of cross-bar 22. Clip 18 includes at least one lanced area 18*j* where a portion of the metal clip is struck, inwardly, to lodge in strut 14 to secure clip 18 to strut 14. The lower portion 18*k* below phantom line 18*p* thus receives the strut 14 while the upper engaging portion 18*m* above phantom line 18*p* receives cross-bar 22 and hold-down bar 24. Locking tab 30 extends upwardly from back wall 18*a* at engaging portion 18*m* and is notched at 18*n* and 18*o* to facilitate bending. Clip 20 is identical to clip 18 in all its detail and like parts have been given like lower case letter references, accompanied by the numeral 20**.

Strut 14 has a flat surface **14*b* for providing a maximum area for the adhesive medium and rounded edges 14*c*, 14*d* where side surfaces 14*e*, 14*f* join front surface 14*g* to prevent snagging garments carried on the hangers. Strut 16 is identical to strut 14 in all respects and like parts have been given like lower case letters accompanied by the number 16**.

Cross-bar includes a pair of mortices 42, 44 at one end for engaging keying segments 18*d* and 18*e* of clip 18, respectively, and a pair of mortices 46 and 48 at the other end for engaging with segments 20*e* and 20*d*, respectively, of clip 20. Each of edges 50, 52 and 54 of cross-bar 22 are rounded to prevent snagging and to facilitate receiving either round or square hanger hooks. A chamfer 56 is provided to accommodate the neck of the hanger hooks. The bottom 58 of cross-bar 22 is relatively flat to accommodate the flat surfaces 14*a* and 16*a* of struts 14 and 16 which support cross-bar 22 when it is mounted in clips 18 and 20.

Hold-down bar 24 also includes a pair of mortices 60, 62 at one end for receiving keying segments 18*d* and 18*e* of clip 18 and a second pair of mortices 64, 66 for receiving keying segments 20*e* and 20*d* of clip 20.

Figure 3:
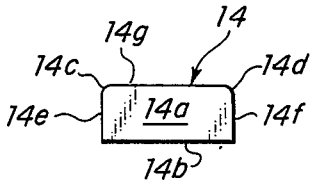
FIG. 3 is an end view of a strut shown in FIG. 2.
Figure 4:
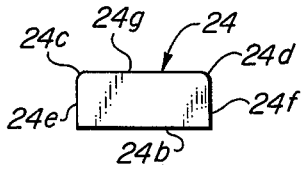
FIG. 4 is an end view of the hold-down bar shown in FIG. 2.
Figure 5:
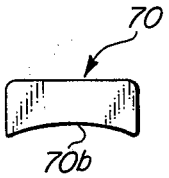
FIG. 5 is an end view of an alternative hold-down bar formed to lock round hook hangers.

Struts 14 and 16 as exemplified by strut 14, FIG. 3, have the same cross-sectional shape as hold-down bar 24, FIG. 4: hold-down bar 24 has a back surface 24*b* and rounded edges 24*c* and 24*d* where side surfaces 24*e* and 24*f* join front surface 24*g*. This is done so that hold-down bar 24 can be made from the scraps left over from the manufacture of struts 14 and 16 for economy in manufacturing. An alternative hold-down bar 70, FIG. 5, may be identical in all respects with hold-down bar 24 with the exception that its back surface 70*b* will be shaped concavely to better accommodate the contour of round hanger hooks.

Figure 6:
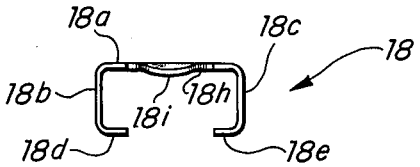
FIG. 6 is an end view, viewing from the bottom, of a clip shown in FIG. 2.
Figure 7:
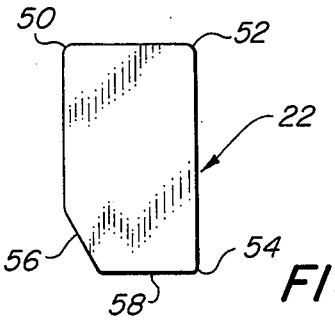
FIG. 7 is an end view of the cross-bar shown in FIG. 2.

As shown in FIG. 2 and more particularly in FIGS. 3, 4 and 7, struts 14 and 16, hold-down bar 24, and cross-bar 22 all have the same width dimension: in FIGS. 3, 4 and 7 that is the lateral dimension across the drawing. In addition struts 14 and 16 and hold-down bar 24, particularly as shown in FIGS. 3 and 4 have the same thickness dimension as well. This is the dimension shown in the longitudinal direction in the drawings. This enables the same basic stock to be used for the struts and the bars and allows the scrap from the construction of the struts to be used to make the hold-down bars. In addition these features of similar size coupled with the construction of the clips 18 and 20 as shown in FIG. 6 with virtually the same cross-section facilitate ease in packaging and shipping of the entire hanger support structure.

Figure 9:
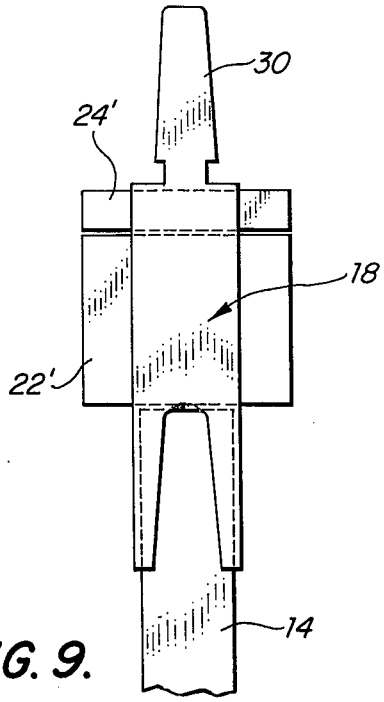
FIG. 9 is an end view of a hold-down bar and a cross-bar each of increased width and mounted in a clip.
Figure 10:
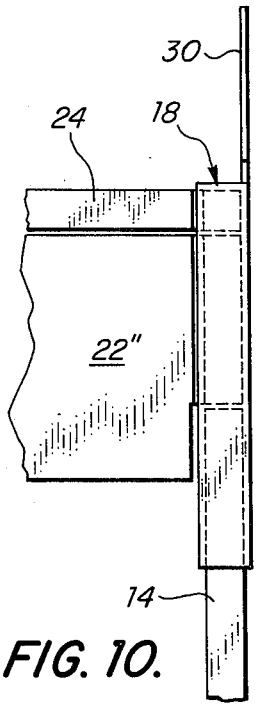
FIG. 10 is a front view of a portion of a hold-down bar and a cross-bar of increased thickness mounted in a clip.
Figure 11:
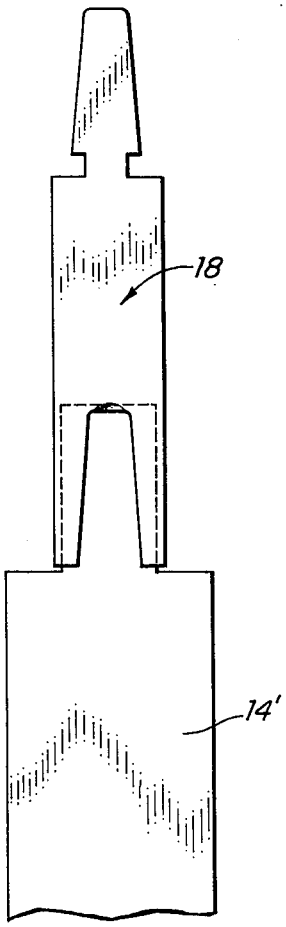
FIG. 11 is a back view of a strut of increased width with a standardized clip mounted thereon.
Figure 12:
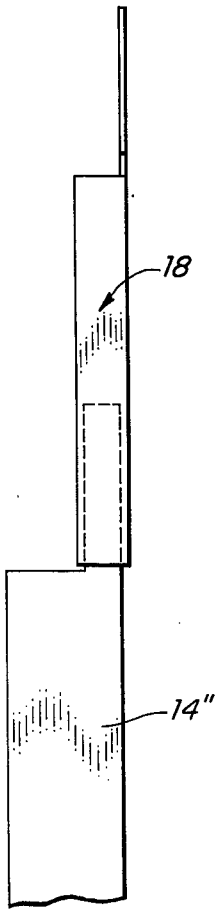
FIG. 12 is a front view showing a strut of increased thickness with a standard size clip mounted thereon.

However, these features are not a necessary limitation of the invention, as shown in FIGS. 8–12 where like parts have been given like numbers with respect to the previous figures and similar parts like numbers primed. Specifically, in FIG. 8, hold-down bar 24 is used in combination with cross-bar 22' which has substantially increased width. In FIG. 9, both hold-down bar 24' and cross-bar 22' have been substantially increased in width. In FIG. 10, cross-bar 22'' has been substantially increased in thickness. In FIG. 11, strut 14' has a substantially increased width and in FIG. 12, strut 14'' has substantially increased thickness. Thus, as is now apparent from the previous discussion each or any combination of the hold-down bar, cross-bar and struts may be increased either in the width dimension or the thickness dimension to meet different load requirements. The length of the cross-bar 22 and hold-down bar 24 as well as the height of struts 14 and 16 may be increased or decreased to accommodate containers of various sizes. Although the clips 18 and 20 have been shown thus far as standard in size regardless of the width or thickness of the various components this is not a necessary limitation of the invention as they may be made proportionately larger to accommodate any changes in the rest of the structure.

Figure 13:
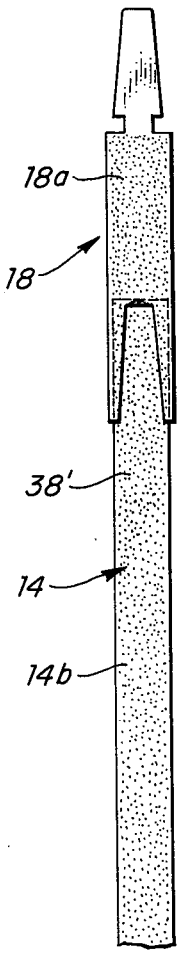
FIG. 13 is a back view of a strut having a clip mounted thereon with the backs of both the clip and the strut covered with an adhesive coating.
Figure 14:
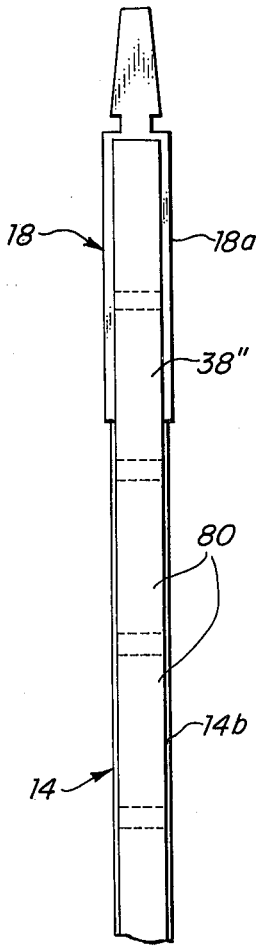
FIG. 14 is a view similar to FIG. 13 with a double-sided adhesive tape in place of the coating.

Adhesive material such as hot melt glue 38', Thermogrip No. 1315, may be applied to the back surface 14*b*, FIG. 13, of strut 14 only as far as clip 18 or may as well be applied continuously, over the back wall 18*a* of clip 18. Alternatively, a double-sided adhesive tape, 38'', FIG. 14, may be applied on the back wall 14*b* of strut 14. It may also extend over the back wall 18*a* of clip 18. Glue 38' and tape 38'' may be applied continuously or in segments 80 indicated by the phantom lines in FIG. 14.

Other embodiments will occur to those skilled in the art and are within the following claims:

What is claimed is:

1. A hanger support structure for a shipping container comprising:

a pair of struts;

a pair of clips for receiving and extending above the top end of each of said struts, respectively; the part of each said clip extending above a said strut forming an engaging portion; each of said clips having a back wall, two side walls, joining said back wall, two keying segments joined to said side walls and forming a part of a front wall;

a cross-bar having a locking portion at each end including a pair of mortises on opposite sides of said cross-bar for engaging said keying segments with said locking portion which is received in said engaging portion of said clip; each said clip including a recess in the lower portion of its back wall of the same shape and size as a said locking portion; and adhesive means on the back of each said strut for fastening each said strut to a portion of a shipping container.

2. The hanger support structure of claim 1 in which said clip includes an inwardly directed dimpled area along said lower edge on the upper border of said recess for limiting downward motion of said clip on a said strut.

3. A clip for receiving a strut, cross-bar and hold-down bar of a support structure for a shipping container, comprising: a back wall; two side walls joined to said back wall; two keying segments joined to said side walls and forming part of a front wall; said clip including a lower portion for receiving a strut and an upper engaging portion for receiving said bars; and a locking tab extending outward from said back wall; said clip including a recess in the lower portion of its back wall of the same shape and size as said locking tab.

* * * * *